United States Patent [19]

Dinkel et al.

[11] Patent Number: 4,764,220

[45] Date of Patent: Aug. 16, 1988

[54] METHOD AND APPARATUS FOR CLEANING A POWDER COATING BOOTH

[75] Inventors: Bernard Dinkel; Silvano Gelain, both of St. Gall, Switzerland

[73] Assignee: Ransburg-Gema AG, Switzerland

[21] Appl. No.: 717,187

[22] Filed: Mar. 29, 1985

[30] Foreign Application Priority Data

Apr. 2, 1984 [DE] Fed. Rep. of Germany ..... 3412275

[51] Int. Cl.[4] ..... B08B 7/00

[52] U.S. Cl. ..... 134/6; 15/93 R; 15/246; 15/266; 134/9; 134/16; 134/22.1; 134/22.12

[58] Field of Search ..... 15/93 R, 301, 246, 266, 15/316 R, 318, 93 C; 134/6, 9, 16, 18, 23, 22.1, 22.12; 198/736, 737

[56] References Cited

U.S. PATENT DOCUMENTS

| | | | |
|---|---|---|---|
| 3,790,007 | 2/1974 | Sprague | 15/93 C |
| 3,999,744 | 12/1976 | Kotch | 15/93 R |
| 4,363,586 | 12/1982 | Gessler et al. | 198/737 |

FOREIGN PATENT DOCUMENTS

| | | | |
|---|---|---|---|
| 2254458 | 5/1973 | Fed. Rep. of Germany | 15/93 |
| 1212868 | 8/1981 | Fed. Rep. of Germany | 198/736 |
| 244937 | 12/1966 | U.S.S.R. | 198/736 |

*Primary Examiner*—Patrick P. Garvin
*Assistant Examiner*—Sharon T. Cohen
*Attorney, Agent, or Firm*—Ostrolenk, Faber, Gerb & Soffen

[57] ABSTRACT

A powder coating booth has a bottom surface on which powder is collected and from which the powder should be removed. Two scrapers are supported on a transport device which move them together. Each scraper is movable from its respective end of the booth toward a central collection region. Since the scrapers are moved simultaneously, one is moving toward the collection region while the other is moving away. As a scraper moves toward the central collection region, it scrapes powder from the surface and delivers it to the collection region. Each scraper swings into an operating, surface scraping position as it moves from its respective end of the booth toward the collection region, and swings into an upraised, non-scraping position, as each moves from the collection region back to the end region. A cable with scraper engaging flights on it is movable for engaging the scrapers and for moving and for swinging them. The scraper moving cable exits from the booth through a wall and a gas nozzle external to the wall blows powder off the cable and back into the booth.

12 Claims, 2 Drawing Sheets

METHOD AND APPARATUS FOR CLEANING A POWDER COATING BOOTH

BACKGROUND OF THE INVENTION

The present invention relates to a method of cleaning a surface of a powder coating booth, and particularly the floor, and relates to a powder coating booth having a device for cleaning one of its surfaces, particularly the floor.

SUMMARY OF THE INVENTION

The invention cleans a surface, particularly the floor, of a powder coating booth with a scraper device. It is the object of the invention to avoid the scraper device having to be moved over the entire length of the surface to be cleaned.

Upon a change from one type, e.g. the color, or powder to another type of powder, the booth must be entirely freed of traces of the previous powder. The required standstill time for the cleaning must not be lengthy. For this reason, the powder scraper device should contribute to shortening of the standstill time. The scraper device, however, not only cleans the booth surface during standstill, but can also be actuated, continuously or intermittently, during operation to scrape off the surface to be cleaned.

In a preferred embodiment, the surface to be cleaned is the floor of the powder spraying booth. In the middle of that floor, there is an opening extending over the entire width of the floor. A powder container is arranged below that opening. The scraper device scrapes powder which has accumulated on the floor from the ends of the booth and into the opening. The powder then drops into the powder container.

Scraping of the surface begins at two starting positions that are located spaced from each other, and the scraping ends at a powder collecting region of the surface which is located between the starting positions. There are two scrapers, arranged spaced one behind the other. Each is moved from a respective one of the starting positions toward the collecting region and is then moved back again into the starting position. The direction of forward movement of the one scraper is the same as the direction of rearward movement of the other scraper. The scraper which moves forward to the collecting region is moved at the beginning of this forward movement into an operation position which is directed against the surface to scrape it. The scraper which moves backward from the collection region in the direction toward its starting position is moved at the beginning of this rearward movement away from the surface into a non-operating position.

As a result, each of the scrapers need be moved only over half the length of the surface to be cleaned. Therefore, simpler apparatus is required than for a scraper which must be moved over the entire length of the surface to be cleaned. Dividing the surface to be scraped in two also reduces by one-half the amount of powder with each case scraper pushes in front of it. This results in better cleaning of the surface and less dirtying of the device which actuates the scraper.

In accordance with one particular embodiment of the invention, a single drive element, a strand, including an endless cable, is provided for both scrapers. Through flights on the cable, the cable operates the two scrapers to move simultaneously and it also causes the scrapers to swing as appropriate between the downward and upraised conditions.

Other objects and features of the invention are described below with reference to the accompanying drawings.

DESCRIPTION OF A PREFERRED EMBODIMENT

Figure 1:
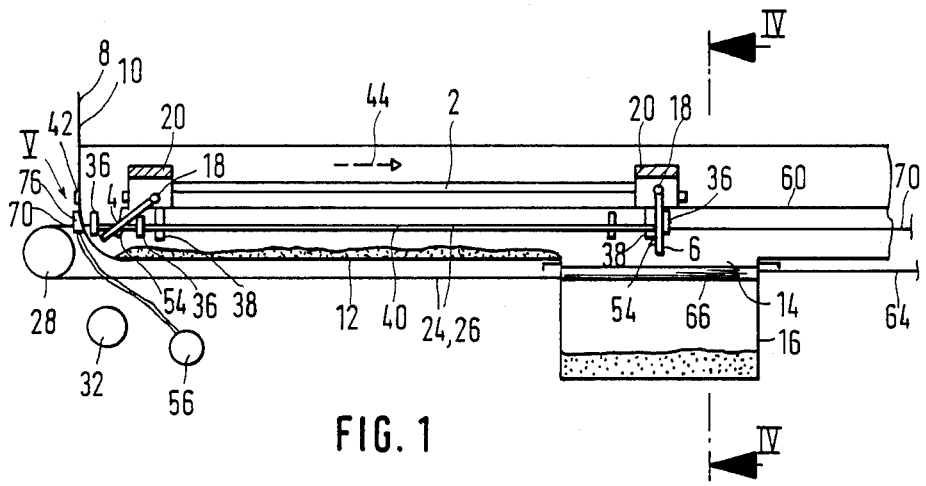
FIG. 1 shows the lower left-hand part of a spray coating booth according to the invention, seen in longitudinal section substantially along the planes I—I of FIG. 4.

FIG. 1 shows a scraper-carriage unit 2 which carries two scrapers 4 and 6. They are shown in a position pushed to the left with respect to drawing FIG. 1 in the lower left part of a powder coating booth 8 of the invention. The scraper 4 shown on the left in FIG. 1 is in its starting position while the scraper 6 shown on the right in the drawing is above the powder collection region.

The powder collection region is formed by an opening 14 in the floor 12 of the booth. The opening is located in the center or midway point of the length of the booth 8, and it extends across the entire width of the floor 12 of the booth. Below the opening 14 there is a powder collecting container 16.

The two scrapers 4 and 6 are each mounted in a respective transverse member 18 for pivoting and swinging around a shaft 20 extending transversely across the booth. The transverse members 18 are connected to each other by longitudinal members 22.

Figure 2:
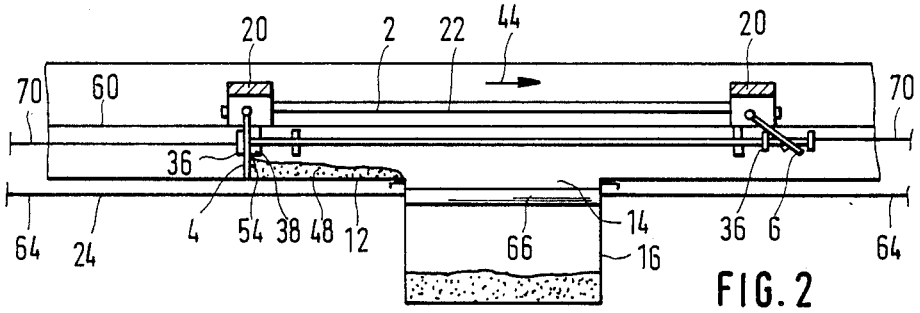
FIG. 2 shows the lower central part of the spray coating booth, in longitudinal section.
Figure 3:
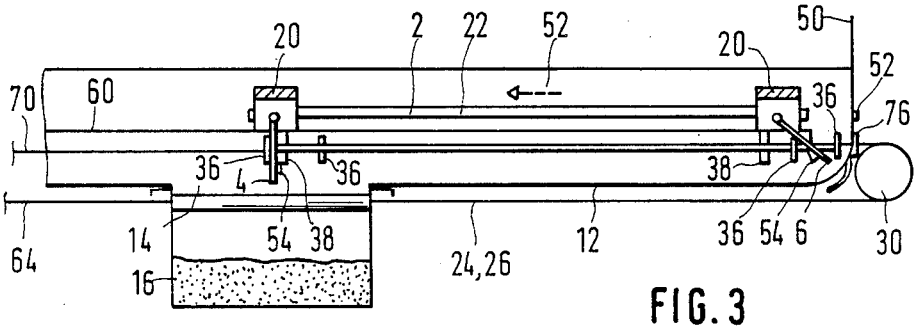
FIG. 3 shows the lower right-hand part of the spray coating booth of FIG. 1.

A drive means 24 includes an endless cable 26 which travels over rollers 28 and 30 which are arranged outside the booth 8. One roller 28 is driven by a motor 32. The cable 26 is passed through a central slot 34 (shown in FIG. 4) in the scrapers 4 and 6. On the outboard side of each scraper, the cable carries flights 36. The flights 36 are seated on a tube 40 which is fastened to the cable 26 which is passed through the tube 40. The scraper pulled by the cable 26, scraper 6 in FIG. 1, lies in each case against a stop 38 on the scraper support member 18. The scraper 6 which is pulled in the forward direction toward the opening 16 pushes the other scraper 4, via the longitudinal member 22, in the rearward direction into its starting position shown in FIG. 1. The flights 36 of the cable 26 swing the other scraper 4 in the rearward direction away from the floor 12 and upward into a non-operating position. The two scrapers 4 and 6 move together in the unit 2 toward the left until, as shown in FIG. 1, the left scraper 4 lies opposite an inductive approximation switch 42, which thus acts as limit switch. The motor 32 for driving the cable 26 is then disconnected or reversed. In the latter case, the cable 26 moves the scraper-carriage unit 2 from the position shown in FIG. 1 toward the right, in the direction indicated by arrow 44. In this connection, first, the right-hand scraper 6 is swung by the flights 36 of the cable 26 in the direction 44 of its rearward movement, corresponding to FIG. 2, into a non-operating position, while the left-hand scraper 4 is swung in the direction of its forward movement, which is the same as the said rearward movement 44 of the other scraper 6, downward against the bottom 12 of the booth into its operating position, until it comes against its stop 38. The entire scraper-carriage unit 2 is then moved in the forward direction 44 by the flights 36 which rest against the left-hand scraper 4. In this connection, the scrapers 4 and 6 have the positions shown in FIGS. 2 and 3. The left-hand scraper 4 sweeps any powder 48 present on the floor 12 into the opening 14 and the collecting container 16 located below same, as shown in FIGS. 2 and 3.

The forward movement 44 of the left-hand scraper 4 continues until it is above the opening 14. At the same time, the right-hand scraper 6 reaches its end position shown in FIG. 3 and lies opposite an inductive approximation switch 52 that is arranged on the right-hand end wall 50 of the booth. The direction of movement of the cable 26 is now reversed again. Now, the right-hand scraper 6 is swung downward by the flights 36 against the floor 12 into the operating position and is moved in the forward direction of the arrow 52 to the opening 14. The direction of forward movement 52 of the right-hand scraper 6 is at the same time the direction of rearward movement of the left-hand scraper 4, which is swung by the flights 36 into its non-operating position, shown in FIG. 1, away from the floor 12 and upward in the return direction 52 and is moved back in the direction 52 into the end position shown in FIG. 1.

The swinging of the two scrapers 4 and 6 and the displacement of the scrapers over the floor 12 toward the opening 14 and back into their starting positions is therefore effected solely and exclusively by the cable 26 via its flights 36 and the stops 38 of the scraper support member 18. The scrapers 4 and 6 are spaced at a distance apart in the longitudinal direction of the booth which is approximately equal to half the length of the floor 12 of the booth. In this way, each scraper need be moved only one half the length of the booth. The two scrapers 4 and 6 are combined to form a unit 2 and are jointly actuated in each case by the single cable 26. As a result, the entire construction is very simple. The switching of the direction of movement of the cable 12 takes place automatically via the limit switches 42 and 52, which, by way of example, are preferably developed as inductive approximation switches.

To avoid accumulations of powder on the scrapers 4 and 6, they can be provided with a plurality of gas nozzles 54 which are directed against the floor 12 and are connected to a source of pressure gas 56.

Figure 4:
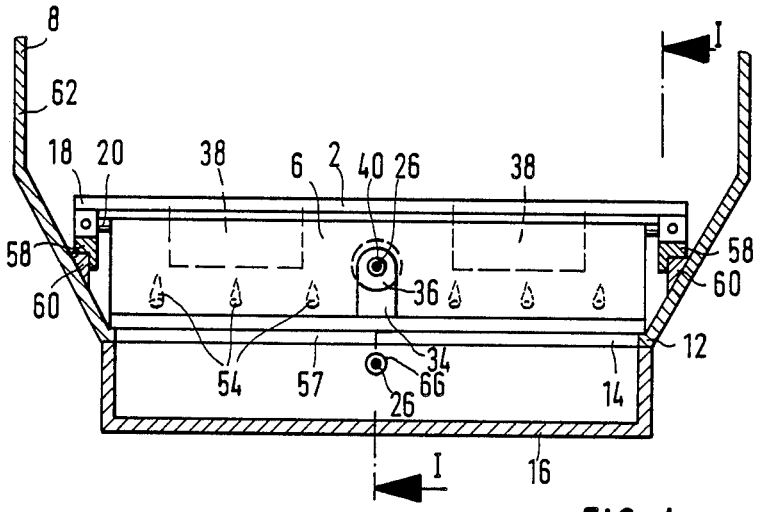
FIG. 4 is a cross-section through the lower part of the spray coating booth of FIG. 1, along the plane IV—IV.

As can be noted from FIG. 4, the opening 14 extends over the entire width of the floor 12 of the booth. The scrapers 4 and 6 can be provided, as shown by the scraper 6 in FIG. 4, with a scraper edge 57 which consists of a different material.

The scraper-carriage unit 2, which carries the two scrapers 4 and 6, is provided on both longitudinal sides with slide elements 58 which are seated on slide rails 60 of the booth side walls 62 and are displaceable on the rails in the longitudinal direction of the booth. In FIG. 4, it can also be seen that the drive means 24 containing the cable 26 extends in the longitudinal direction of the booth in the center of the cab. To avoid dirtying the lower course 64 of the cable 12, which moves below the floor 12 of the booth and passes through the container 16, it is passed through a pipe 66 within the container 16.

Figure 5:
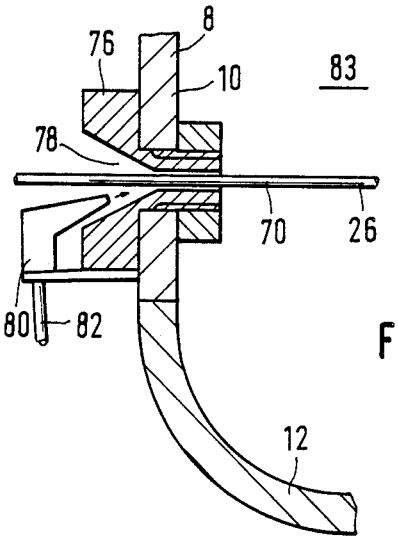
FIG. 5 is an axial section through a detail of construction V of FIG. 1.

As shown in FIGS. 1 and 3, the upper course 70 of the cable 26 is passed through the end walls 10 and 50 of the booth 8. For this purpose, a narrow opening is formed in each of the end walls. In the left-hand wall 10 in FIG. 1, which is shown in enlarged sectional view in FIG. 5, the opening is formed by an insert 76 which has a conical bore 78 which narrows from the outside of the wall in the direction toward the inside of the wall, and through which bore the cable 26 passes. A gas nozzle 80 arranged outside the end wall 10 is connected via a conduit 82 to the source of pressure gas 56 shown in FIG. 1 and within the narrowing bore 78, it blows pressure gas against the cable 26. As a result, any powder adhering to the cable 26 is blown through the borehole 78 past the cable 26 and into the interior 83 of the booth.

The floor 12 of the booth can at all times be maintained so clean by means of the scrapers 4 and 6 that excessively large amounts of powder 40 do not accumulate. This avoids a great accumulation of powder with its risk of explosion, and the booth can be cleaned faster when a change is to be made from one type of powder to another. In that case, the scraper-carriage unit 2 can be easily lifted from the slide rails 60 of the booth and replaced by another scraper-carriage unit so that no operating standstill times occur for the cleaning of the scraper-carriage unit.

The cable 26 is maintained clean at all times by the gas nozzle 80 which is directed through the borehole 78 into the interior 83 of the booth, and the emergence of powder from the booth is also avoided.

Instead of a cable 26, a chain, or alternately actuated reciprocating pistons or other suitable known drive means can be used for the drive strand 24. However, a cable or a chain is the simplest.

Although the present invention has been described in connection with a preferred embodiment thereof, many variations and modifications will now become apparent to those skilled in the art. It is preferred, therefore, that the present invention be limited not by the specific disclosurse herein, but only by the appended claims.

What is claimed is:

1. A powder coating booth and a scraper mechanism therefor, comprising:

a booth chamber having a surface to be scraped, an opening in the surface, and a powder collecting container below the opening, the surface further having first and second end regions and the opening being disposed about midway between the end regions;

a first movable scraper having a first starting position at the first end region and a second movable scraper having a second starting position at the second end region;

a scraper transport device movable along a path extending between the first and second end regions in the booth chamber, the first and second scrapers being spaced from one another, being coupled to the scraper transport device, and being movable in synchronism by the transport device, the first and second scrapers being spaced from one another when the first scraper is at the first starting position the second scraper is at the opening in the surface and when the second scraper is in the second starting position the first scraper is at the opening;

the scraper transport device including:

a linearly displaceable carriage for supporting the first and second scrapers;

guide rails for slidably supporting the carriage thereon, the carriage resting on the guide rails and being removable, hindrance free, by being lifted off the guide rails whereby replacement of the carriage and the first and second scrapers attached thereto is facilitated; and flights for engaging cooperating surfaces on the first and second scrapers, the flights being effective for selectively moving the first and second scraper to disengage from the surface to be scraped, in dependence on the direction of movement of the scraper transport device.

2. The booth and scraper mechanism of claim 1, wherein the transport device comprises an elongate element and the flights are carried on the elongate element.

3. The booth and scraper mechanism of claim 2, wherein the elongate element comprises a cable and the transport device moves the cable.

4. The booth and scraper mechanism of claim 1, wherein the scrapers are supported to the transport device for swinging movement between their operating and non-operating positions.

5. The booth and scraper mechanism of claim 2, wherein the booth has an enclosing wall through which the drive element passes; a gas emitting nozzle being directed over the path of movement of the drive element in the opening and being directed substantially in the direction from outside the wall of the booth toward the interior of the booth.

6. The booth and scraper mechanism of claim 1, wherein the scrapers are provided with gas nozzles that are directed against the surface to be scraped when the scraper moves over that surface in the operating position.

7. The booth and scraper mechanism of claim 1, further comprising inductive approximation switches provided for sensing the proximity of one of the scrapers and being connected with the transport device for operating the transport device to limit forward and rearward motion of the scrapers.

8. The booth and scraper mechanism of claim 7, wherein there is a respective inductive approximation switch toward each of the two end regions and each switch senses the proximity of the respective scraper as the respective scraper is moving rearwardly to a respective end region.

9. The booth and scraper mechanism of claim 1, wherein the scrapers are provided with gas nozzles that are directed against the surface to be scraped when the scraper moves over that surface in the operating position.

10. The booth and scraper mechanism of claim 1, further comprising inductive approximation switches provided for sensing the proximity of one of the scrapers and being connected with the transport device for operating the transport device to limit forward and rearward motion of the scrapers.

11. A method for cleaning collected powder from a powder booth chamber having a surface to be scraped, an opening in the surface, and a powder collection container below the opening, the surface further having first and second end regions, and the opening being disposed midway between the end regions, said method comprising the steps:

providing a first scraper having a first starting position at the first end region and a second scraper having a second starting position at the second end region;

transporting the first and second scrapers in synchronism along a path located between the first and second end regions by utilizing a scraper transport device; said device moving the first scraper towards said first starting position, and simultaneously the second scraper away from the second starting position, and toward the opening and alternatingly moving the first scraper from the first starting position toward the opening.

12. The method of claim 11, wherein the scrapers are swung between an operating and a non-operating position at the start of the scrapers' movement toward the opening and at the start of the scrapers' movement away from the opening, respectively.

* * * * *